United States Patent [19]

Stanley

[11] Patent Number: 4,689,972

[45] Date of Patent: Sep. 1, 1987

[54] YARN DRYING AND DYE SETTING APPARATUS

[75] Inventor: Frankie B. Stanley, Dalton, Ga.

[73] Assignee: J. W. Yarbrough, Chatsworth, Ga. ; a part interest

[21] Appl. No.: 781,529

[22] Filed: Sep. 30, 1985

[51] Int. Cl.[4] ..... D06F 3/04

[52] U.S. Cl. ..... 68/20; 68/5 D; 34/24; 242/47.01

[58] Field of Search ..... 68/5 D, 189, 198, 157, 68/158, 20; 8/149.3, 151.2; 242/47.01, 47.12, 47.13, 104, 47.09; 34/24; 28/220, 242, 251, 281

[56] References Cited

U.S. PATENT DOCUMENTS

| | | | |
|---|---|---|---|
| 1,627,059 | 5/1927 | Neidich | 68/176 |
| 3,426,553 | 2/1969 | Erb | 68/5 D |
| 3,683,650 | 8/1972 | Hirschburger | 68/5 D |
| 3,709,444 | 1/1973 | Tannert | 242/47.12 X |
| 3,774,384 | 11/1973 | Richter | 68/5 D X |
| 3,955,769 | 5/1976 | Kajiura et al. | 242/47.01 |
| 3,972,176 | 8/1976 | Lawson, Jr. et al. | 28/281 X |
| 4,277,867 | 7/1981 | Lucke | 68/5 D |
| 4,316,370 | 2/1982 | Steiner | 68/5 D |
| 4,351,118 | 9/1982 | Von Canon et al. | 34/24 |
| 4,383,655 | 5/1983 | Ahrendt et al. | 242/47.12 X |
| 4,414,756 | 11/1983 | Simpson et al. | 68/5 D X |
| 4,558,575 | 12/1985 | Serracant | 68/177 X |

FOREIGN PATENT DOCUMENTS

| | | | |
|---|---|---|---|
| 1936664 | 7/1969 | Fed. Rep. of Germany | 242/47.01 |
| 2511353 | 2/1983 | France | 242/47.01 |

*Primary Examiner*—Harvey C. Hornsby
*Assistant Examiner*—Frankie L. Stinson
*Attorney, Agent, or Firm*—Rodgers & Rodgers

[57] ABSTRACT

Yarn drying and dye setting apparatus comprising an enclosure having an inlet for receiving a dyed yarn strand and an outlet for discharging the strand, a fan and heater for circulating heated air within the enclosure, a reel comprising a pair of spaced side wheels rotatably mounted in the enclosure on which the yarn strand is wound, a plurality of rods extending between the side wheels, and the rods being angularly related with respect to the axis of the reel to facilitate movement of the yarn along the rods during the drying and dye setting process.

9 Claims, 6 Drawing Figures

YARN DRYING AND DYE SETTING APPARATUS

TECHNICAL FIELD

During the production of yarn from its undyed condition to its ultimately dyed condition, the yarn must initially be dyed and then properly conditioned. The conditioning process generally involves the introduction of warm air to the yarn. Since the yarn is wet from the dye material, the heated air simultaneously sets the dye and drys the yarn so as to place the yarn in a condition for winding on an appropriate spool so that it can be further utilized such as in the production of carpeting.

Heretofore the processing of a continuous strand of yarn has been slow and unreliable because, as the processing speed is increased, adjacent strands of yarn tend to interact frictionally with each other causing breakage in the strand of yarn. Of course the entire process must be stopped and can only be restarted after the breakage is repaired.

BACKGROUND ART

Various types of apparatus as well as varying methods are used in the processing and conditioning of yarn and similar elements such as are disclosed in the following United States patents:

U.S. Pat. No. 4,414,756
U.S. Pat. No. 4,316,370
U.S. Pat. No. 3,972,176
U.S. Pat. No. 3,774,384
U.S. Pat. No. 3,696,601
U.S. Pat. No. 3,632,092

DISCLOSURE OF THE INVENTION

By this invention, yarn drying and dye setting apparatus is provided and comprises an enclosure having air entry and exhaust ports, a yarn entry port and a yarn discharge port, means for circulating heated air within said enclosure, a reel rotatably mounted within said enclosure on which the yarn is wound and comprising a pair of spaced side wheels, a plurality of rods extending between the side wheels, each of the rods comprising a yarn entry end and a yarn exit end, and the radius between the axis of the reel and the entry end being greater than the radius between the axis of the reel and the exit end.

BEST MODE FOR CARRYING OUT THE INVENTION

Figure 1:
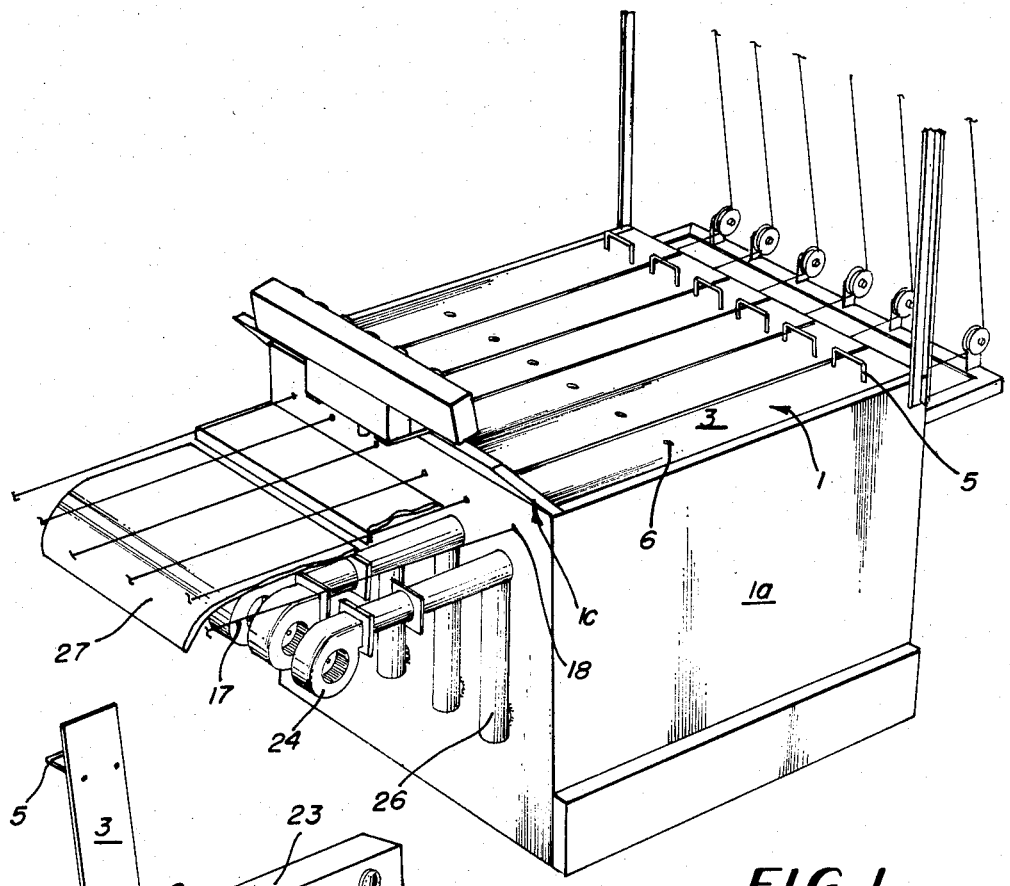
FIG. 1 is a perspective view of the yarn drying and dye setting apparatus constructed according to this invention.
Figure 2:
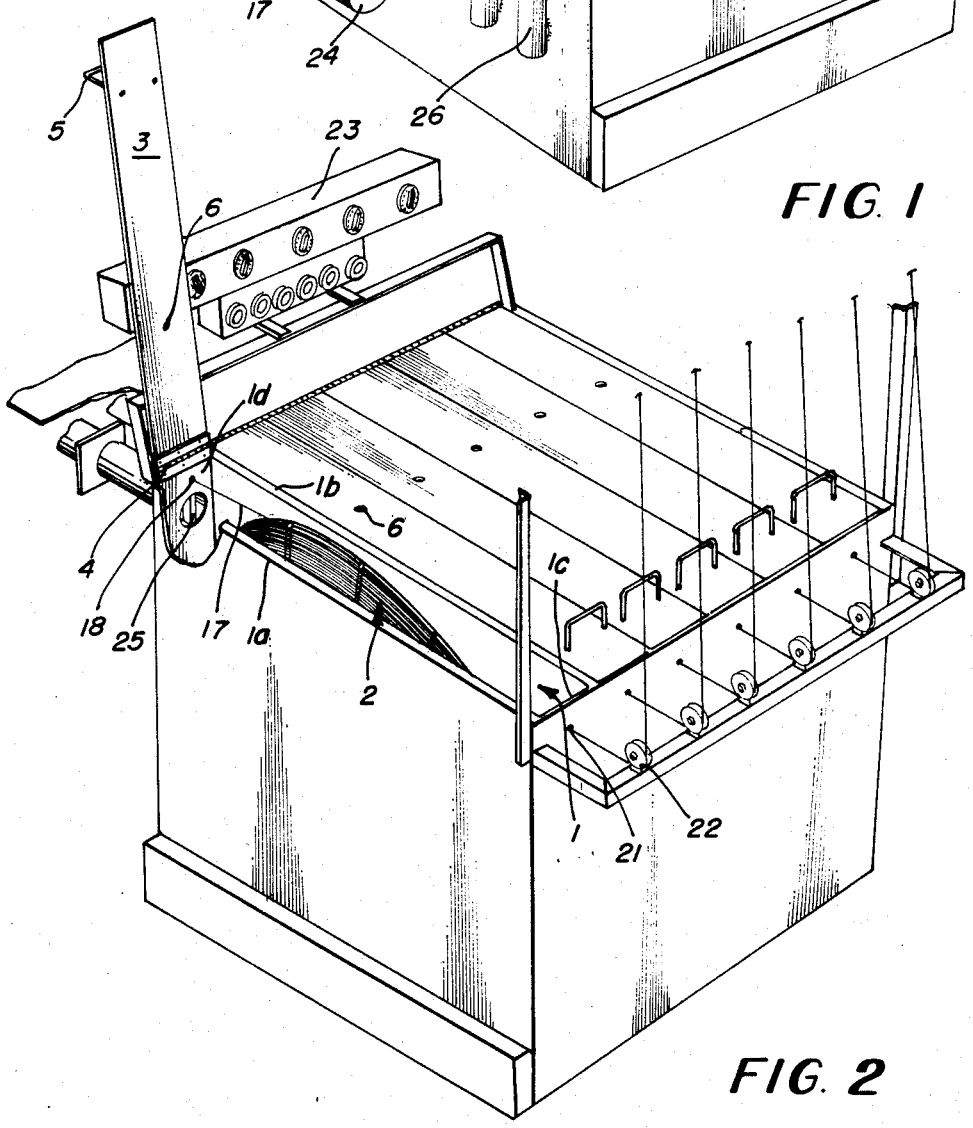
FIG. 2 is a perspective view taken from the opposite end than that shown in FIG. 1.

In the drawings and with particular reference to FIGS. 1 and 2, the yarn drying and dye setting apparatus constructed according to this invention is shown in its entirety. More specifically, means is provided for processing six independent strands of yarn fiber. Since the structural elements associated with the processing of each single strand of yarn are essentially identical, only the elements associated with a single strand of yarn will be described in detail. Although the apparatus shown in FIGS. 1 and 2 provides means for the processing of six strands of yarn, by this invention, the apparatus could be adapted to process any number of strands of yarn.

In FIGS. 1 and 2, one of the six enclosures of the invention is generally identified by the numeral 1. Enclosure 1 is in the shape of a box having sides 1*a* and 1*b*, ends 1*c* and 1*d* and a bottom wall, which receives a reel generally identified by the numeral 2. Enclosure 1 is provided with a lid 3 which is rotatably connected to enclosure 1 by means of hinge 4 and is further provided with handle 5. Formed in lid 3 is an exhaust aperture 6.

Figure 3:
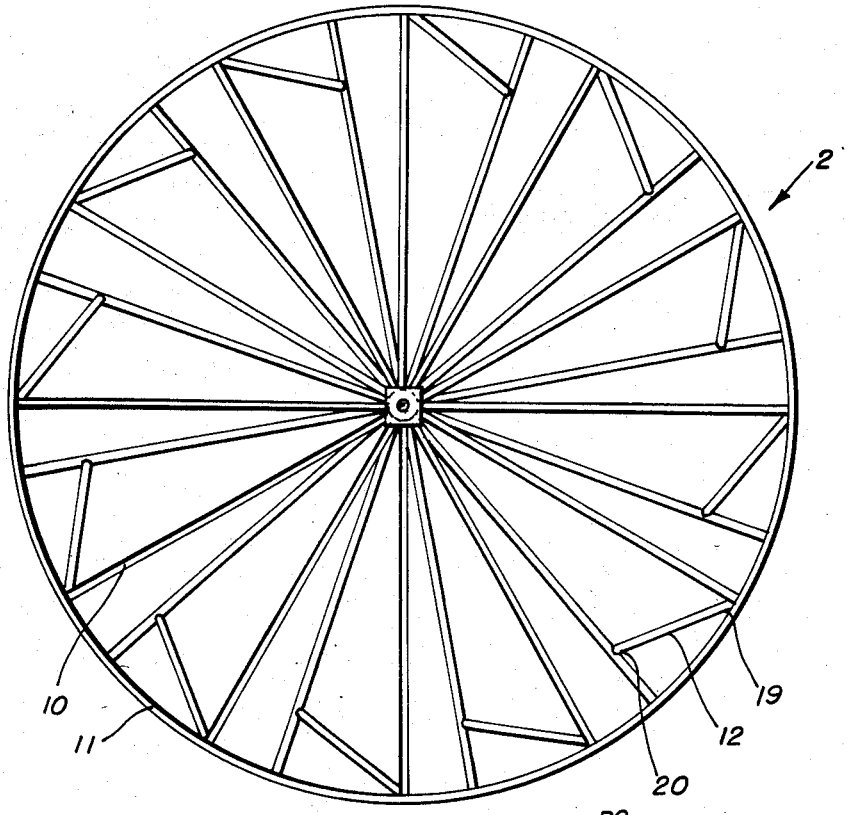
FIG. 3 is a side elevational view of the reel element of the apparatus.
Figure 4:
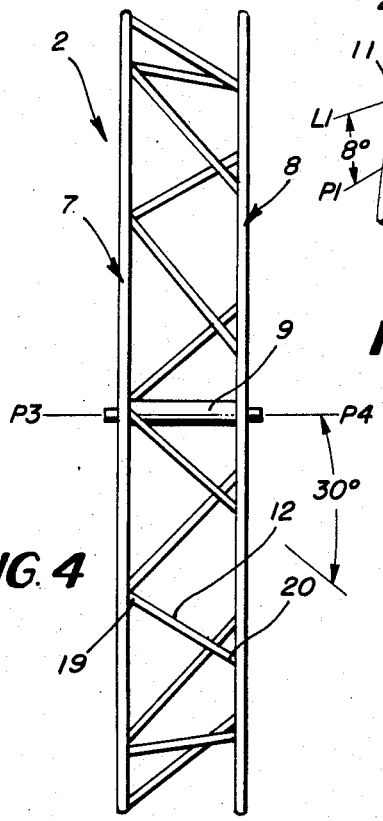
FIG. 4 is an end elevational view of the reel.

As best shown in FIGS. 3 and 4, reel 2 is provided with spaced side wheels generally identified by the numerals 7 and 8. In addition, reel 2 is provided with axle 9. Each of the side wheels 7 and 8 is provided with multiple spokes 10 which extend radially outward from axle 9. The ends of spokes 10 remote from axle 9 are interconnected by means of rim 11. According to a feature of this invention, rods 12, at the ends thereof, are secured, respectively to spokes 10 of side wheel 7 and generally adjacent spokes 10 of side wheel 8. For the purpose of mounting reel 2 inside of enclosure 1 and to allow rotation thereof, U-shaped plates 13 and 14 are secured, respectively, such as by welding, to the interior surfaces of side walls 1*a* and 1*b* of enclosure 1.

Figure 5:
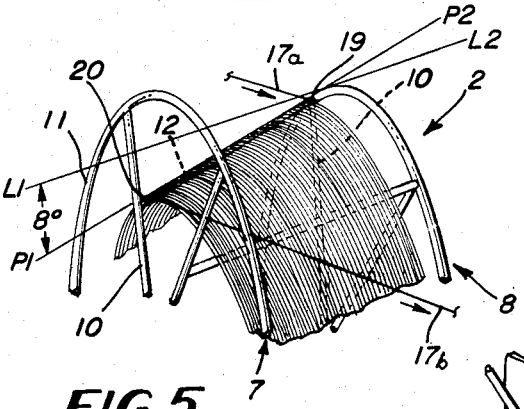
FIG. 5 is a partial perspective view of the reel showing yarn wound thereon.
Figure 6:
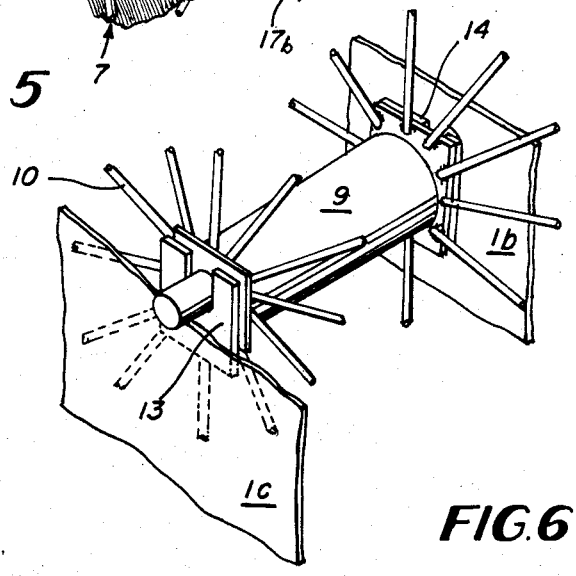
FIG. 6 is a perspective view of the reel axle and associated structure.

As best viewed in FIGS. 1, 2 and 5 wet dyed yarn 17 enters enclosure 1 through aperture 18 wherein it then proceeds to come into contact with yarn entry end 19 of the associated rod 12. Yarn 17 is then wound around rods 12 of reel 2 an appropriate number of times depending on the length of time appropriate for the drying and dye setting of the particular yarn involved. This is best viewed in FIG. 5. Ultimately yarn 17 proceeds from rods 12 at yarn exit end 20 and out of enclosure 1 through aperture 21 and then around pulley 22 following which it is wound on an appropriate spool beam or the like as is well known. Such spool or beam is operated by a motor driven device which draws the yarn through the dyeing and drying operations.

Air is forced into enclosure 1 by means of blower 24 through aperture 25 wherrein the air is effectively circulated around yarn 17 disposed on reel 2. The circulated air ultimately is removed from enclosure 1 through return conduit 26 and then recirculated into enclosure 1. Of course, it is desirable to heat the circulated air which can be accomplished externally in connection with blower 24 or by means of heating elements mounted internally in enclosure 1 in a conventional manner. In order to avoid interference between yarn 17 and blowers 24, plate 27 is provided and is disposed therebetween and mounted on the wall of the dryer housing.

Of critical importance when yarn 17 is wound around rods 12 of reel 2, is the necessity to prevent the entanglement or frictional engagement of adjacent strands of yarn during the drying and dye setting process. If such engagement should occur, the yarn will most likely break thereby forcing a shut down of the entire dyeing and drying process for that particular strand of yarn. It is also necessary to provide for shrinkage of the yarn during drying.

In order to minimize the possibility of breakage rods 12 are disposed in a compound angular relationship with respect to the axis of reel 2 such that the radius of the axis of reel 2 at the yarn entry end 19 is greater than the radius of the axis of reel 2 at the yarn exit end 20. Optimally rod 12 lies in an imaginary plane P1-P2 as indicated in FIG. 5. which is disposed at an angle of 8 degrees to an imaginary line L1-L2 shown on FIG. 5 and disposed parallel to the axis of reel 2 and which imaginary line intersects the point 19 at which rod 12 is interconnected to side wheel 8 as shown, for example, in FIGS. 3, 4 and 5. Although this angle is optimally 8 degrees, the apparatus is still operable if such angle is in the range between 5 and 11 degrees.

In addition to the angular disposition just described with respect to rods 12, each rod is angularly offset from an imaginary plane P3-P4 intersecting the axis of reel 2 and the point 19 at which rod 12 is connected to side wheel 8 as indicated in FIG. 4. The optimum magnitude of this angle is 30 degrees but is within operational parameters from 25 to 35 degrees.

The straight portion 17*a* of strand 17 entering the reel at entry end 19 of the topmost rod 12 is disposed at an obtuse angle to the topmost rod 12 and the portion 17*b* of strand 17 leaving the reel near the yarn exit end of topmost rod 12 is also disposed at an obtuse angle to the topmost rod 12.

Therefore, yarn 17 is disposed on reel 2 such that as reel 2 rotates succeeding windings of yarn simply side downwardly along rods 12 due to the compound angle just described from entry ends 19 toward exit ends 20 to accommodate shrinkage during which time the dye is set and the yarn is effectively dried. These compound angles not only accommodate shrinkage, they serve to prevent overlapping of one wrapping relative to an adjacent wrapping of the strand wound on reel 2. Such overlapping is very deleterious and if it occurs will prevent proper sliding of the spiraled strand. Testing has shown that the apparatus effectively processes yarn at a rate of up to 1500 feet of yarn per minute.

A method and apparatus for dyeing yarn which are well suited for use in conjunction with this invention is disclosed and claimed in U.S. patent application Ser. No. 781,418 filed Sept. 30, 1985.

INDUSTRIAL APPLICABILITY

By this invention, yarn drying and dye setting apparatus is provided which is efficient at high speeds and extremely reliable so as to reduce undesirable down time to a minimum. Also there is no waste of fibers or of dye and hence no pollution of the environment because there is little if any discharge of steam.

I claim:

1. Drying and dye setting apparatus for a strand of yarn comprising an enclosure having air entry and exhaust ports, a yarn entry port and a yarn discharge port, means for circulating heated air within said enclosure, a reel rotatably mounted in said enclosure on which said yarn is wound, said reel comprising a pair of rotatably spaced side wheels, said reel having an axis, a plurality of rods fixedly secured to and extending between said spaced side wheels, each of said rods having a yarn entry end adjacent one of said side wheels and a yarn exit end adjacent the other of said side wheels, and the radius between said axis and said yarn entry ends being greater than the radius between said axis and said yarn exit ends and each of said rods being angularly disposed relative to an imaginary plane containing and intersecting said axis and the connection between each rod and said one side wheel.

2. Apparatus according to claim 1 wherein each of said rods is disposed in an imaginary plane and wherein each imaginary plane is disposed at an angle of approximately 8 degrees to an imaginary line disposed parallel to said axis and intersecting the connection between said rod and said one side wheel.

3. Apparatus according to claim 2 wherein each of said imaginary planes is disposed at an angle within the range of 5 to 11 degrees to its imaginary line.

4. Apparatus according to claim 1 wherein the angle of disposition of each rod relative to said imaginary plane is approximately 30 degrees.

5. Apparatus according to claim 1 wherein the angle of disposition of each of said rods relative to said imaginary plane is within the range of 25 to 35 degrees.

6. Apparatus according to claim 1 wherein the portion of the yarn strand entering said reel is straight and disposed at an obtuse angle to the topmost one of said rods.

7. Apparatus according to claim 6 wherein means is provided to heat said air.

8. Apparatus according to claim 1 wherein the portion of the yarn strand leaving said reel is straight and disposed at an obtuse angle to the topmost one of said rods.

9. Apparatus according to claim 1 wherein forced air is introduced into and circulated within said enclosure.

* * * * *